US005896150A

United States Patent [19]

Kobayashi et al.

[11] Patent Number: 5,896,150

[45] Date of Patent: Apr. 20, 1999

[54] INK-JET TYPE RECORDING HEAD

[75] Inventors: Atsushi Kobayashi; Tatsuo Furuta; Fumiyuki Kanai; Shinri Sakai; Hiroshi Hosokawa, all of Nagano, Japan

[73] Assignee: Seiko Epson Corporation, Tokyo, Japan

[21] Appl. No.: 08/156,909

[22] Filed: Nov. 24, 1993

[30] Foreign Application Priority Data

| | | | |
|---|---|---|---|
| Nov. 25, 1992 | [JP] | Japan | 4-315335 |
| Jan. 27, 1993 | [JP] | Japan | 5-011975 |
| Feb. 17, 1993 | [JP] | Japan | 5-028191 |
| May 6, 1993 | [JP] | Japan | 5-105578 |
| May 20, 1993 | [JP] | Japan | 5-118561 |
| Oct. 27, 1993 | [JP] | Japan | 5-291187 |

[51] Int. Cl.[6] ..... B41J 2/045; B41J 2/04

[52] U.S. Cl. ..... 347/71; 347/54

[58] Field of Search ..... 347/68, 70, 71, 347/54, 63, 65; 29/890.1; 156/625.1, 644.1, 653.1, 657.1, 662.1

[56] References Cited

U.S. PATENT DOCUMENTS

| | | | |
|---|---|---|---|
| 4,047,184 | 9/1977 | Bassous et al. | 347/76 |
| 4,312,008 | 1/1982 | Taub et al. | 347/71 |
| 4,364,066 | 12/1982 | Koto | 347/70 |
| 4,367,480 | 1/1983 | Kotoh | 347/71 |
| 4,516,140 | 5/1985 | Durkee et al. | 347/71 |
| 4,611,219 | 9/1986 | Sugitani et al. | 347/63 X |
| 4,666,823 | 5/1987 | Yokota et al. | 347/65 X |
| 4,786,357 | 11/1988 | Campanelli et al. | 156/644 X |

FOREIGN PATENT DOCUMENTS

| | | | |
|---|---|---|---|
| 0322228 | 6/1989 | European Pat. Off. . | |
| 0433628 | 8/1991 | European Pat. Off. | B41J 2/045 |
| 9209111 | 5/1992 | WIPO . | |

*Primary Examiner*—David F. Yockey

*Attorney, Agent, or Firm*—Sughrue, Mion, Zinn Macpeak & Seas, PLLC

[57] ABSTRACT

In an ink-jet type recording head including a nozzle plate provided with nozzle openings, a spacer provided with partitions for partitioning pressure generating chambers, ink supply ports and reservoirs, and a plate member sandwiched and fixed together. Displacement of the plate member is produced by piezoelectric vibrators to thereby generate ink droplets. The spacer is formed by anisotropic etching of a silicon single crystal substrate so that the pressure generating chambers, the ink supply ports and the reservoirs are formed as through-holes communicated with each other. Accordingly, etching conditions for the respective through-holes are made equal to each other. In different embodiments, the spacer includes chamfered portions or a plurality of fine planes and steps along which adhesive spreads during assembly of the head. In a further embodiment, the spacer includes different length partitions are between the pressure generating chambers.

6 Claims, 13 Drawing Sheets

INK-JET TYPE RECORDING HEAD

BACKGROUND OF THE INVENTION

The present invention relates to an ink-jet type recording head for generating pressure in pressure generating chambers substantially instantaneously by expansion/-contraction of piezoelectric vibrators or by heat elements to thereby jet ink droplets from nozzle openings in response to the change in pressure.

In an ink-jet type recording head in which dots on a recording medium are formed from ink droplets, printing with very high resolution can be made by reducing the ink droplet size, but it is necessary to increase the number of nozzle openings for the purpose of performing printing efficiently. Particularly in the case of an ink-jet recording head using piezoelectric vibrators as ink droplet jetting sources, it is necessary to increase the size of pressure generating chambers as to use the energy of the piezoelectric vibrators efficiently. However, this is contrary to the requirement of reducing the size of the recording head.

To resolve the aforementioned problems, there is generally used a method of setting walls which partition adjacent pressure chambers in such a manner as to be as thin as possible and of making the shape of the pressure generating chambers larger in the direction of the length thereof to thereby increase the volume thereof.

Such pressure generating chambers or reservoirs are formed by making through-holes in a spacer, i.e., a member for keeping the distance between a plate member and a nozzle plate at a predetermined value. So as to form through-holes coincident with pressure generating chambers having the required very small and complex shape, an etching technique is used generally.

A laminate of photosensitive resin films is used generally as a material constituting the aforementioned spacer. When such a photosensitive resin film laminate is used, there arises an advantage in that a desired pattern can be formed extremely accurately due to the fact that such materials are well suitable for photolithography, and due to the fact that the adhesive property thereof can be used so that no adhesive agent is required for fixing the laminate to the plate member and the nozzle plate. On the other hand, there is a disadvantage in that crosstalk, distortion, etc., can occur because of the low mechanical strength of the material, so that the quality in printing is lowered when this material is applied to a recording head with high resolution.

Moreover, since a plurality of resin films are laminated there is a risk of separation, so that the thickness of the spacer is limited by the characteristics of the material. There also arises a problem in that it is difficult to make the volume of each of the pressure generating chambers suitable for an ink-jet type recording head.

To solve the aforementioned problems, a proposal has been made in which a silicon single crystal substrate of crystal orientation (110) is used, and pressure generating chambers in the form of through-holes and ink supply ports and nozzle openings in the form of grooves of a depth providing a fluid resistance required for these openings are formed by anisotropic etching of a silicon single crystal substrate (see U.S. Pat. No. 4,312,008).

There, however, arises a problem in that not only is controlling of the manufacturing process complicated because it is necessary to precisely control the etching depth, but it is difficult to control the volume in positions necessary for securing fluid resistance to a precise degree, for instance in the ink supply ports, because the etched sectional shape is inherently a V-shape or a trapezoidal shape.

SUMMARY OF THE INVENTION

The present invention is based on such circumstances, and an object thereof is to provide a novel ink-jet type recording head in which pressure generating chambers, ink supply ports and reservoirs can be formed with a high accuracy by etching of a crystalline substrate.

To solve the aforementioned problems, according to the present invention, there is provided an ink-jet type recording head comprising: a nozzle plate provided with nozzle openings for jetting ink droplets; a spacer provided with partitions for partitioning pressure generating chambers, ink supply ports and reservoirs; a plate member fixed to the other surface of the spacer so as to be opposite to the nozzle plate, the nozzle plate, the spacer and the plate member being sandwiched and fixed to each other; and pressure generating means for exerting a change of pressure suitable for forming ink droplets on the pressure generating chambers; characterized in that the spacer is formed by etching a silicon crystalline substrate or a silicon oxide crystalline substrate from its opposite surfaces so that the pressure generating chambers, the ink supply ports and the reservoirs are formed in the form of through-holes communicated with each other; and the spacer is formed in the form of a cantilever so that the partitions for partitioning the pressure generating chambers and the ink supply ports are connected to a body on the nozzle opening side, and the partitions form free ends on the reservoir side.

Because the reservoirs, the pressure generating chambers and the ink supply ports partitioned by the spacer are formed in the form of through-holes from one surface to the other surface, accuracy is provided simply and without the necessity of controlling the etching depth strictly.

DESCRIPTION OF THE PREFERRED EMBODIMENTS

Figure 1:
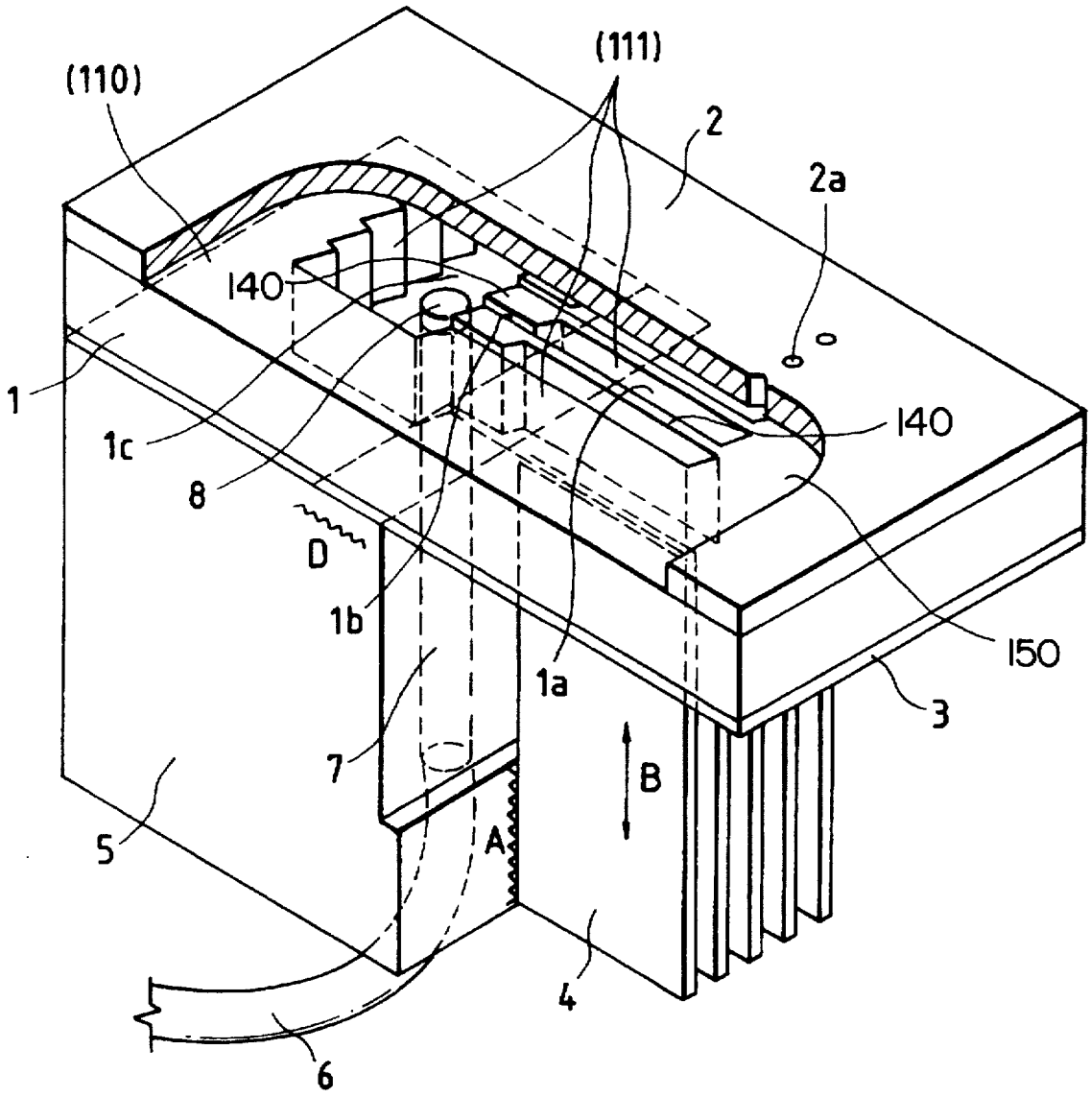
FIG. 1 is a perspective view of an apparatus constructed according to a preferred embodiment of the present invention, showing the structure of a spacer, partly cut away in a nozzle plate.

The present invention now will be further described on the basis of preferred embodiments shown in the drawings.

FIG. 1 shows a first preferred embodiment of the present invention. In the drawing, reference numeral 1 designates a spacer constituting a feature of the present invention. In this embodiment, the spacer is constituted by a silicon single crystal substrate of crystal orientation (110) having a thickness suitable for securing the optimum volume as a pressure generating chamber. In this substrate, a first plurality of through-holes 1*a*, 1*a*, 1*a* . . . to form pressure generating chambers communicated with nozzle openings 2*a*, 2*a*, 2*a* . . . of a nozzle plate 2 at one end, a through-hole 1*c* to form a reservoir supplied with ink from an ink tank not shown and a second plurality of through-holes 1*b*, 1*b*, 1*b* . . . to form ink supply ports for communicating the respective through-holes 1*a*, 1*a*, 1*a* . . . with the through-hole 1*c* (i.e. therethrough-hole) are formed by anisotropic etching (which will be described later), and are disposed between the nozzle plate 2 and a plate member 3 (which also will be described later).

In the drawing, reference numeral 2 designates the nozzle plate as described above. The nozzle plate is provided with the nozzle openings 2*a*, 2*a*, 2*a* . . . formed at intervals of a predetermined pitch, for example, 180 DPI, and is airtightly fixed to one surface of the spacer 1.

Reference numeral 3 designates the plate member which is airtightly fixed to the other surface of the spacer 1 and cooperates with the nozzle plate 2 to form pressure generating chambers. Piezoelectric vibrators 4, 4, 4 . . . are fixed to regions of the plate member 3 facing the pressure generating chambers. The piezoelectric vibrators 4, 4, 4 . . . are formed as vertical vibration type piezoelectric vibrators which vibrate in the directions of the arrows B in the drawing, that is, in the directions perpendicular to the surface of the plate member 3. While one end of each of the piezoelectric vibrators abuts the plate member 3 as described above, the other end (the region represented by the wavy line A in the drawing) is fixed to a pedestal 5 by an adhesive agent.

In the pedestal 5, there is formed a through-hole 7 having one end communicated with an ink tank (not shown) through a tube 6 and the other, opposite end connected to an ink flow-in port 8 and to the through-hole 1*c* to form a reservoir as described above. The reservoir side containing the through-holes 1*b*, 1*b*, 1*b* . . . to form ink flow passages is fixed so that a region (represented by the wave line D in the drawing) shaped like a cantilever (reference numeral 140) by the through-holes 1*a*, 1*a*, 1*a* . . . and 1*b*, 1*b*, 1*b* . . . is supported without inhibition of vibration by the piezoelectric vibrators of the plate member.

Figure 3A:
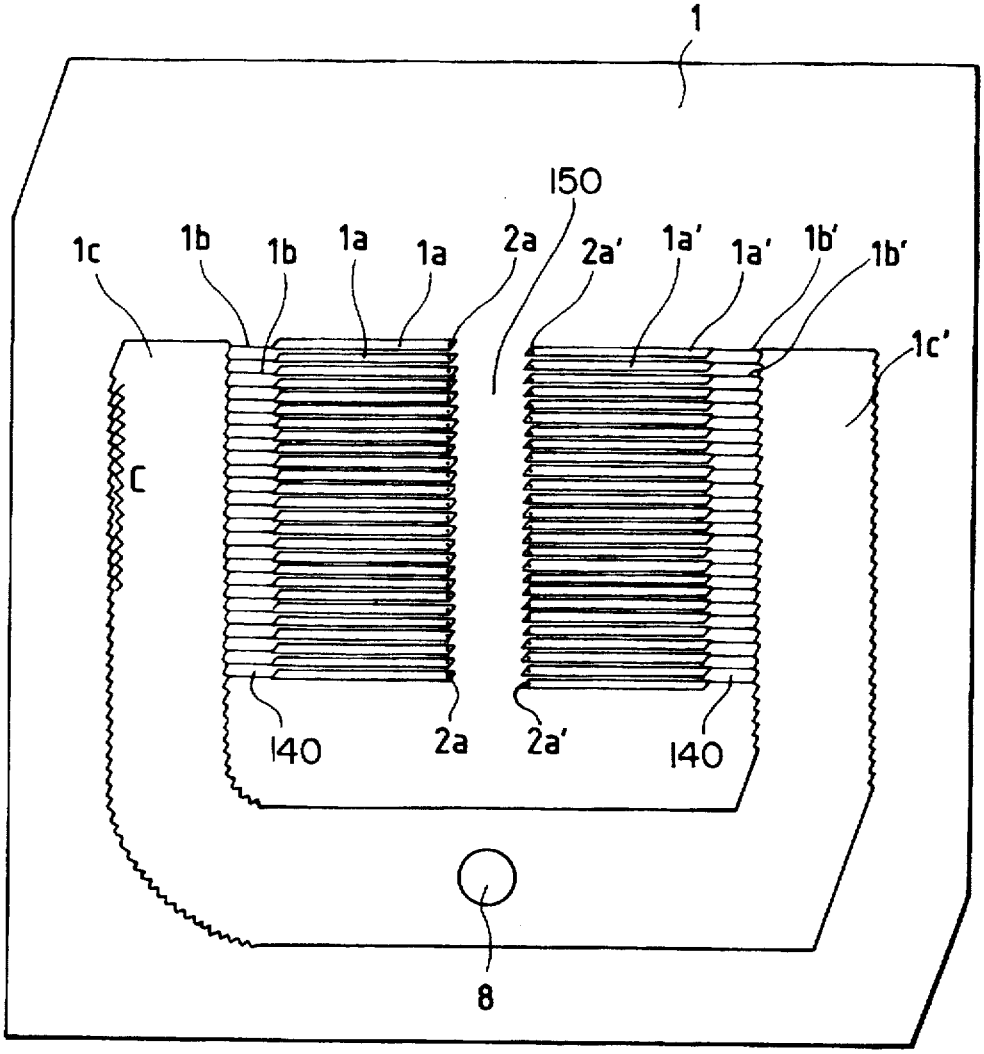
FIGS. 3(*a*) and 3(*b*) are enlarged views respectively showing the arrangement of through-holes formed in the spacer and the vicinity of the through-holes.
Figure 4A:
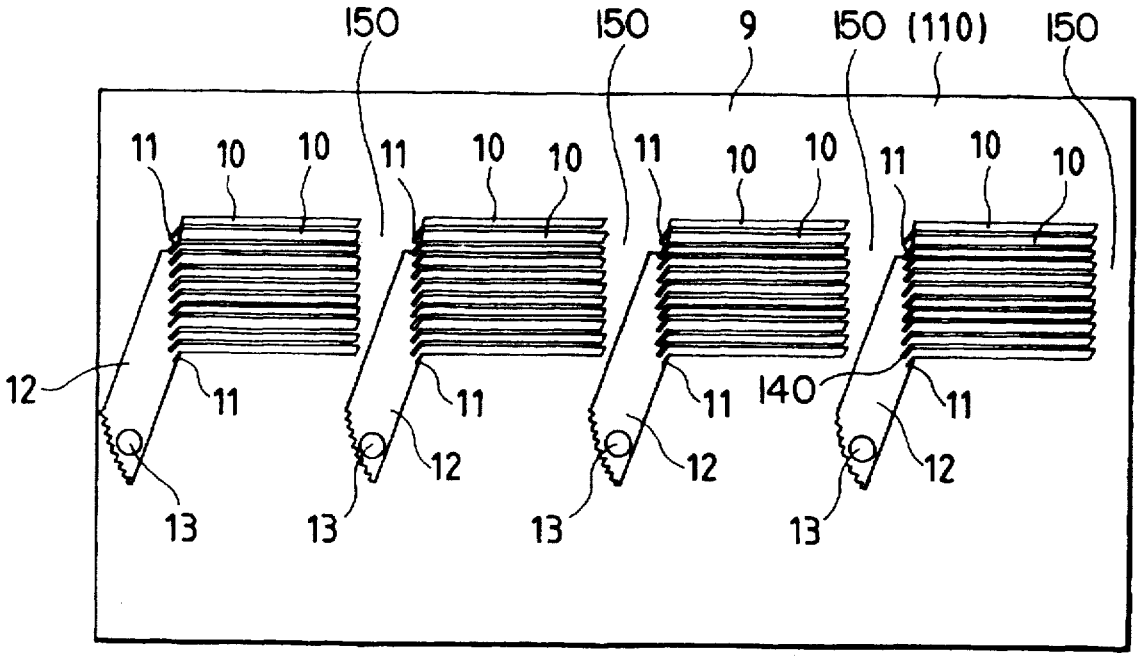
FIGS. 4(*a*) and 4(*b*) are enlarged views respectively showing the arrangement of through-holes formed in the spacer and the vicinity of the through-holes.

FIG. 1, reference numeral 150 designates a particular part of spacer 1 which hereafter shall be referred to as the body of the spacer. Conceptually, the body is an easy idea to grasp. As used herein, the body is the part of the spacer to which the cantilevered parts 140 (also referred to as cantilevered partitions) of the spacer are connected. The body 150 might be in only one part of the spacer, as illustrated in FIG. 1. FIG. 3(A) shows a spacer in which the body is centrally located. In FIG. 3(A), the body has cantilevered portions 140 connected to it on two sides. In FIG. 4(A), a spacer is shown in which body 150 is present in four locations on one spacer. As will be appreciated, therefore, the body 150 of the spacer is the part of the spacer to which an end of at least one cantilevered portion is connected. Description of the invention will now proceed with reference to FIG. 2.

Figure 2:
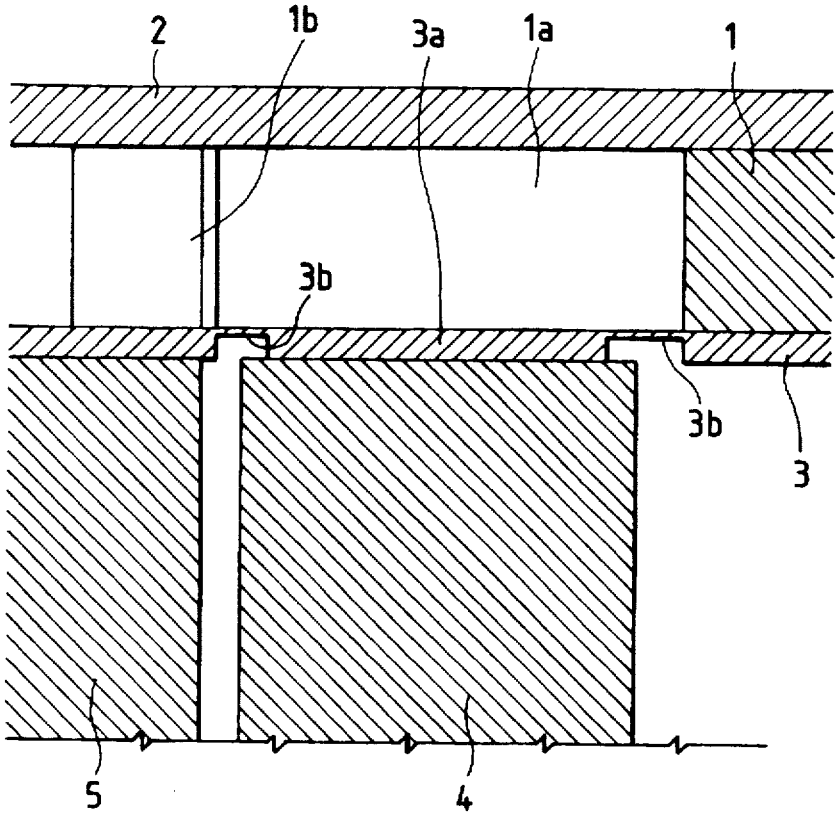
FIG. 2 is an enlarged sectional view showing the vicinity of pressure generating chambers in the apparatus.

FIG. 2 is an enlarged view of the vicinity of the pressure generating chambers in the aforementioned ink-jet type recording head. In this embodiment, for use of the displacement of the plate member 3 due to the piezoelectric vibrators, the plate member 3 which cooperates with the through-holes 1*a* of the spacer 1 and the nozzle plate 2 to form pressure generating chambers has island portions 3*a* formed as thick portions for transmitting the expansion/-contraction of the piezoelectric vibrators 4 to the whole of the pressure generating chambers, and thin portions 3*b* formed to surround the island portions.

When the piezoelectric vibrators 4 in the aforementioned structure expand/contract in the directions of the arrows B in the drawing (FIG. 1), a range as wide as possible, of the pressure generating chambers expands/-contracts through the plate member 3. In the case of contraction, ink in the pressure generating chambers is jetted in the form of ink droplets from the nozzle openings. In the case of expansion, ink in the reservoir flows into the pressure generating chambers through the ink supply ports constituted by the through-holes 1*b*.

Figure 3B:
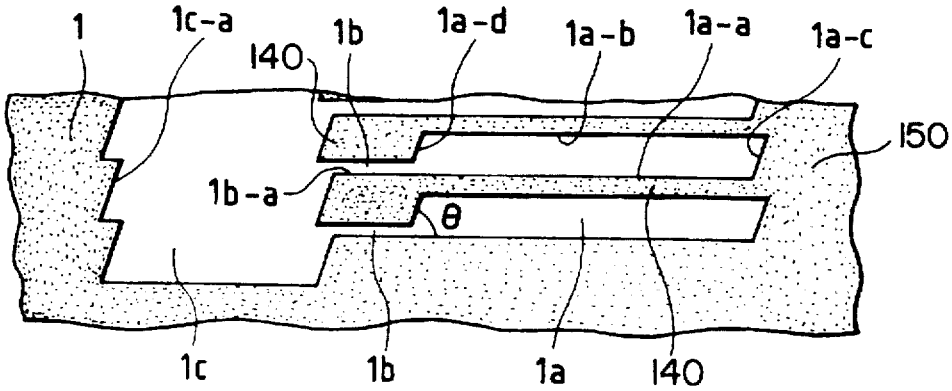

FIG. 3(*a*) shows an embodiment of the aforementioned spacer. In this embodiment, the case where the spacer is applied to a recording head of the type in which the nozzle openings are arranged at intervals of a predetermined pitch, for example, 141 μm will be described as an example.

In the drawing, reference numerals 1*a*, 1*a*, 1*a*. . . and 1*a*', 1*a*', 1*a*' . . . designate through-holes which form respective pressure generating chambers. The through-holes are arranged so as to be substantially symmetrical to each other with respect to a center line in accordance with the arrangement of nozzle trains. The sides of the through holes facing each other are communicated with nozzle openings of a nozzle plate (not shown). In the opposite sides of the through-holes 1*a* and 1*a*', there are formed through-holes 1*b*, 1*b* . . . and 1*b*', 1*b* ' . . . to form ink supply ports communicated with reservoirs and through-holes 1*c* and 1*c*' to form reservoirs connected to the through-holes 1b, 1b, . . . and 1b', 1b' . . .

These through-holes 1a, 1b, 1c, 1a', 1b' and 1c' are formed by anisotropic etching of a silicon single crystal substrate having crystal orientation (110), as will be described in more detail later. Accordingly, each of the through-holes 1a forming pressure generating chambers as shown in FIG. 3(*b*) is substantially shaped like a parallelogram constituted by wall surfaces 1a-a, 1a-b, 1a-c and 1a-d perpendicular to a surface of the substrate. Of the two wall surfaces 1a-a and 1a-b extending in the length-wise direction of the through-hole 1a to form a pressure generating chamber, wall surface 1a-a abuts an extention line of the wall surface 1a-d at an acute angle θ in the reservoir side. An extension of the one-wall surface side 1a-a forms wall surface 1b-a which forms one side of a through-hole 1b to form an ink supply port partitioned by a wall surface 1b-a. Wall surface 1b-a is formed in the same plane as the wall surface 1a-a, so that fluid resistance suitable to jetting of ink droplets and supplying of ink to the pressure generating chamber is obtained in accordance with the width and length of the through-hole 1b.

The wall surface 1c-a forming a through-hole 1c as a reservoir is formed to have the optimum shape as a reservoir by zigzag repetition of fine planes for correction of the orientation due to anisotropic etching.

These through-holes 1a, 1a, 1a . . . . 1b, 1b, 1b . . . and 1c are formed as through-holes each passing through a wall from one side to the other side. The wall surfaces partitioning the through-holes are perpendicular to a surface of the substrate 1.

Figure 4B:
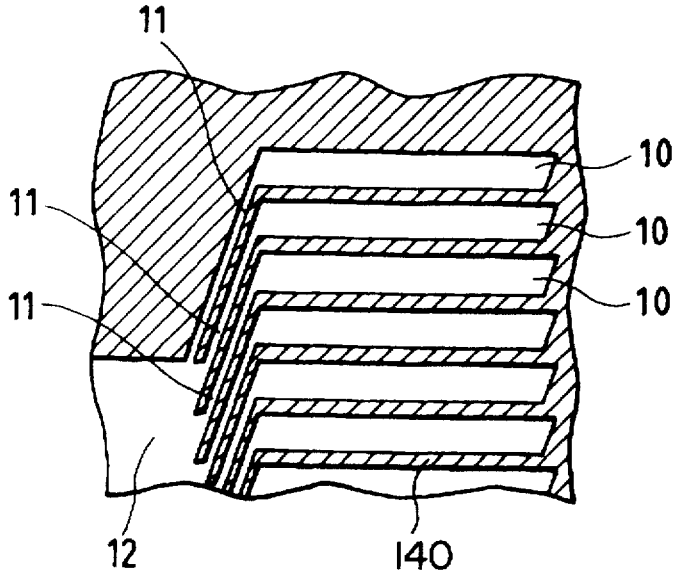
Figure 6A:
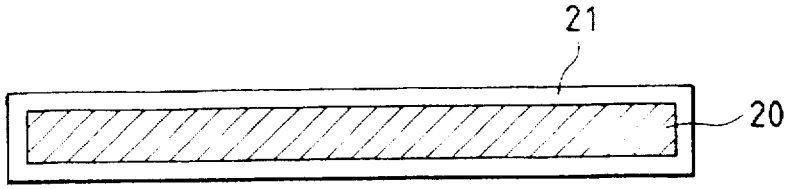
FIGS. 6(*a*) to 6(*e*) are explanatory views showing a method of forming a spacer by anisotropic etching of a silicon single crystal substrate.
Figure 6B:
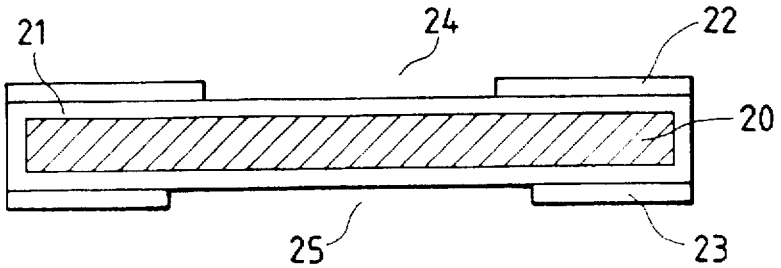
Figure 6C:
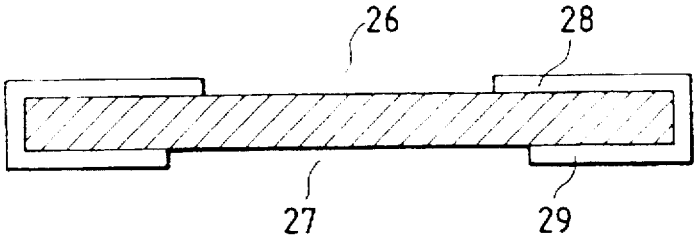
Figure 6D:
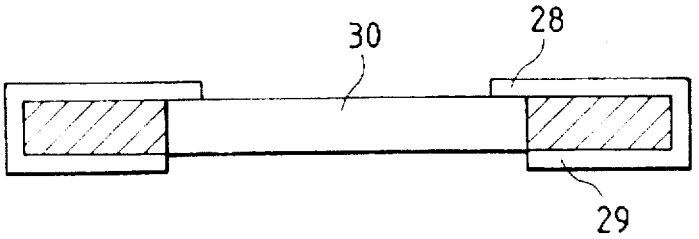
Figure 6E:
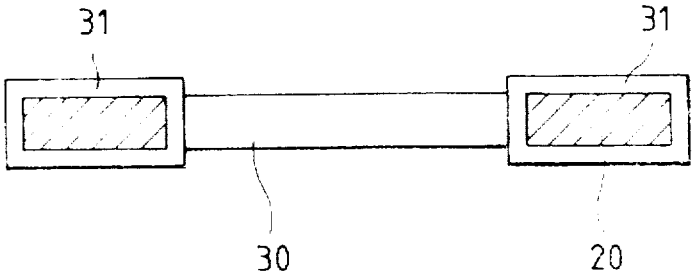

FIG. 4 shows another form of arrangement of the pressure generating chambers. In the drawing, reference numeral 9 designates a silicon single crystal substrate of crystal orientation (110) having the same structure as described above. This embodiment relates to the case where the silicon single substrate is applied to a recording head having 4 nozzle opening trains. In the drawing, reference numerals 10, 10, 10 . . . designate through-holes forming respective pressure generating chambers. These are formed as through-holes by anisotropic etching of the two sides of the silicon single crystal substrate in the same manner as described above. In one end of each of the through-holes 10, 10, 10 . . . , that is, in a side opposite to the nozzle opening side, there are formed through-holes 11, 11, 11 . . . to form ink supply ports. Unlike the aforementioned embodiment, these through-holes 11, 11, 11 . . . are arranged so as to be parallel to each other to form an angle of 35° with respect to an axial line of the through-holes 1b as pressure generating chambers. Through-holes 12, 12, 12 . . . as reservoirs are connected to the through-holes 11, 11, 11 . . . as the respective groups of ink supply ports. Further, ink flow-in ports 13, 13, 13 . . . communicated with an ink tank are connected to respective ones of the through-holes 12, 12, . . . . The through-holes 10, 10, 10 . . . forming pressure generating chambers and the through-holes 11, 11, 11 . . . forming ink supply ports are connected to each other at an angle of about 110°, as shown in FIG. 4(*b*). Because they are accordingly arranged so that discontinuous portions are reduced as much as possible, points of connection between pressure generating chambers 10 and ink supply ports 12 are smoothed so that bubbles and the like can be prevented from stagnation.

Figure 5:
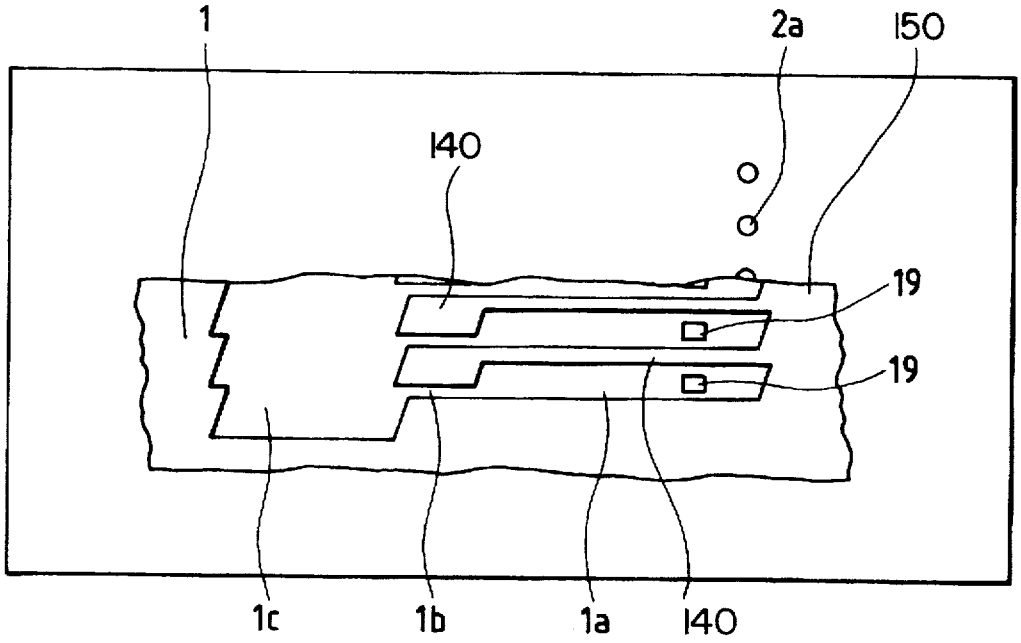
FIG. 5 is a view showing an embodiment in the case where the present invention is applied to a bubble jet type recording head.

Although the aforementioned embodiment concerns the case where pressure for jetting ink droplets is generated by changing the shape of each of the pressure generating chambers through the piezoelectric vibrators of the plate member, the same effect can be achieved in the case where electric resistance elements 19, 19, 19 . . . are fixed to the plate member 3 and mounted in the through-holes 1a, 1a, 1a . . . constituting pressure generating chambers, as shown in FIG. 5. In the latter embodiment, pressure sufficient to jet ink droplets can be generated through instantaneous evaporation of a very small amount of ink due to Joule heating by supplying electric currents to the electric resistance elements 19, 19, 19 . . . in accordance with printing signals.

FIGS. 6(*a*)–6(*e*) shows the process of producing the aforementioned spacer. In the drawing, reference numeral 20 designates a silicon single crystal substrate of crystal orientation (110) having a thickness of, for example, 220 μm, necessary for functioning as a spacer. A silicon dioxide film 21 having a thickness of, for example, about 1 μm, necessary for functioning as a protective film in anisotropic etching is formed on the whole surface of the silicon single crystal substrate by the method of heat oxidation (FIG. 6(*a*)).

Hydrogen fluoride resisting protective films 22 and 23 having windows 24 and 25 coincident with the aforementioned through-holes 1a, 1b and 1c are formed on front and rear surfaces of the substrate 20 coated with the silicon dioxide film 21 by photolithography (FIG. 6(*b*)).

When etching is carried out with hydrogen fluoride in this condition, the silicon dioxide film 21 is partly removed in accordance with the windows 24 and 25 to form through-holes 1a, 1b and 1c. As a result, silicon dioxide films 28 and 29 having windows 26 and 27 for silicon single crystal etching are formed (FIG. 6(*c*)).

When etching is carried out with an aqueous solution of about 17% potassium hydroxide kept at a constant temperature, for example, 80° C., in the stage in which silicon dioxide patterning is finished as described above, portions of the windows 26 and 27 are selectively subjected to etching in parallel to the plane of crystal orientation (111) from the front and rear surfaces at a speed of about 2 μm per minute with use of the silicon dioxide patterns 28 and 29 as protective films (FIG. 6(*d*)).

In the stage in which a through-hole 30 is formed by anisotropic etching from the front and rear surfaces in the aforementioned manner, the silicon dioxide films 28 and 29 used as masks are removed with hydrogen fluoride and then heat oxidation is carried out again to form a silicon dioxide film 31 having a sufficient thickness, for example, about 1 μm, as a protective film on the whole exposed surface. As a result, the silicon dioxide film 31 is used as a protective film against ink (FIG. 6(*e*)).

Figure 7A:
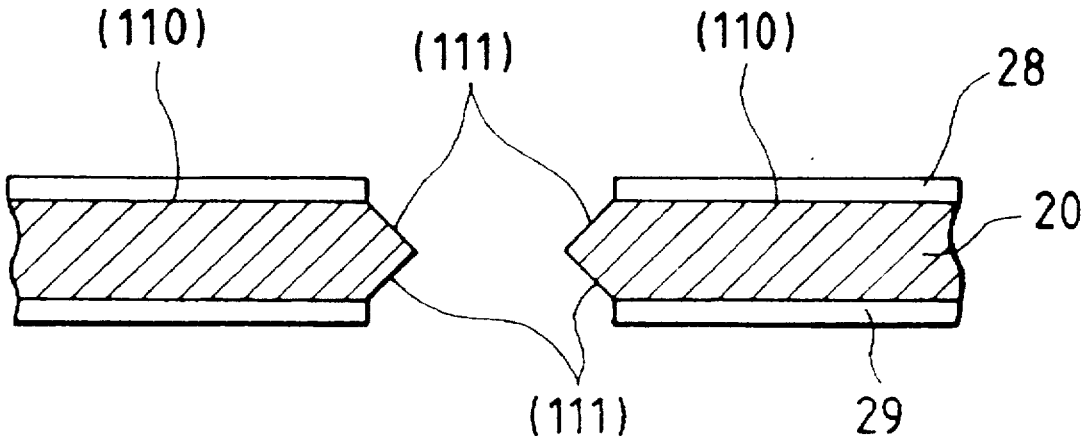
FIGS. 7(*a*) and 7(*b*) are explanatory views showing an etching process in the case where a silicon single crystal substrate of crystal orientation (110) is subjected to anisotropic etching.
Figure 7B:
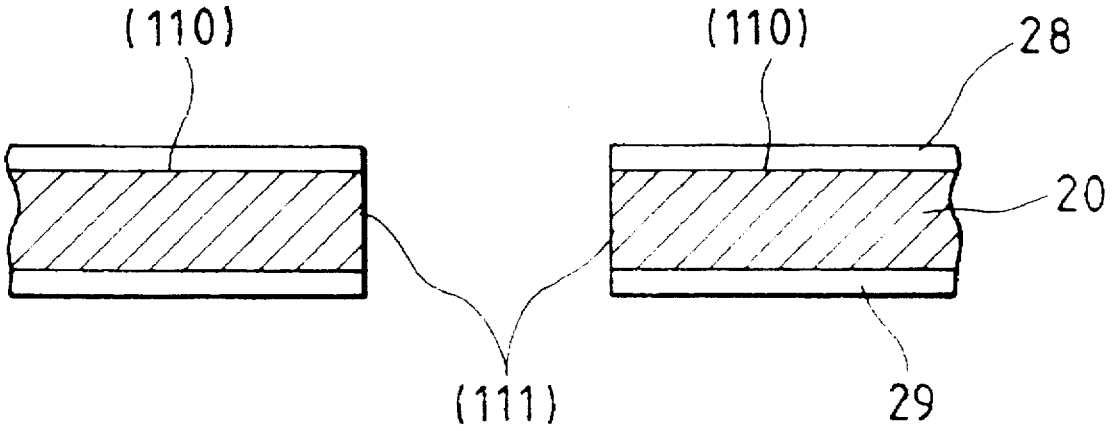
Figure 8A:
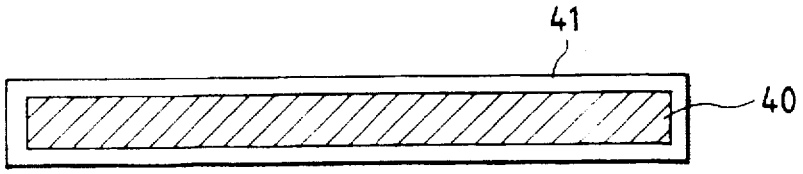
FIGS. 8(*a*) to 8(*e*) are explanatory views showing a producing process in the case where a synthetic crystal substrate is used as a substrate constituting a spacer.
Figure 8B:
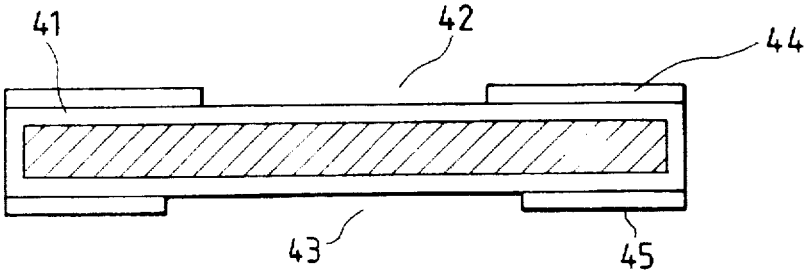
Figure 8C:
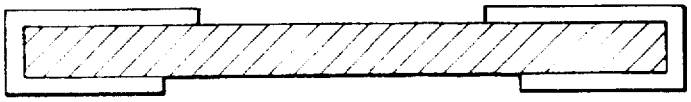
Figure 8D:
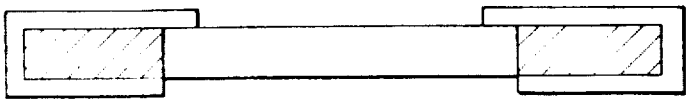
Figure 8E:
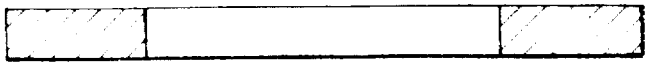

In execution of anisotropic etching of such a silicon single crystal substrate having the plane of crystal orientation (110) as a surface, (111) planes inclined with respect to the crystal orientation (110) as shown in FIG. 7 are formed using a target pattern.

Accordingly, when the flow passage resistance is to be adjusted in accordance with the depth or when the spacer and the nozzle plate are to be constituted by one substrate, the configuration of flow passages is complicated because etching is stopped at the stage in which planes inclined with respect to the surface of the substrate are formed. On the contrary, when etching is carried out so that the substrate is pierced thoroughly, such inclined planes are eliminated so that respective surfaces partitioning a through-hole are formed perpendicular to the surface of the substrate. As a result, a flow passage of the size defined by the etching pattern can be formed.

FIGS. 8(*a*)–8(*e*) shows a producing process in the case where a silicon oxide crystalline substrate, for example, Z-cut synthetic crystal, is used as a substrate constituting a spacer. In the drawing, reference numeral 40 designates a Z-cut synthetic crystal substrate having a thickness, for example, 220 μm, necessary for functioning as a spacer. A metal film 41, for example, a 500 angstrom chromium and 1000 angstrom gold film, is formed on the whole surface of the substrate by sputtering (FIG. 8(*a*)).

Films 44 and 45 having windows 42 and 43 coincident with the aforementioned through-holes 1*a*, 1*b* and 1*c* are formed on front and rear surfaces of the substrate 40 coated with the metal protective film 41 by photolithography (FIG. 8(*b*)).

Then, the gold film and the chromium film are etched with an aqueous solution of potassium iodide and iodine and an ammoniated cerium nitrate etching solution, respectively, and then the resist film is removed with a solution of nitric acid and hydrogen peroxide (FIG. 8(*c*)).

When etching is started from the two surfaces of the substrate with an ammonium bi fluoride saturation aqueous solution or a mixture solution of hydrofluoric acid and ammonium fluoride kept at a predetermined temperature, for example, 80° C., in the stage in which a predetermined etching pattern is formed in the aforementioned manner, etching progresses at a speed of 70 μm per hour (FIG. 8(*d*)).

When the etching of the substrate is finished, the metal film 41 is removed with an aqueous solution of potassium iodide and iodine and an ammoniated cerium nitrate etching solution. In the case where a silicon single crystal substrate is used, it is preferable that a silicon dioxide film be formed as a protective film. It is, however, unnecessary to form a specific protective film, because the crystal has an inherent resistance to chemical corrosion.

Figure 9A:
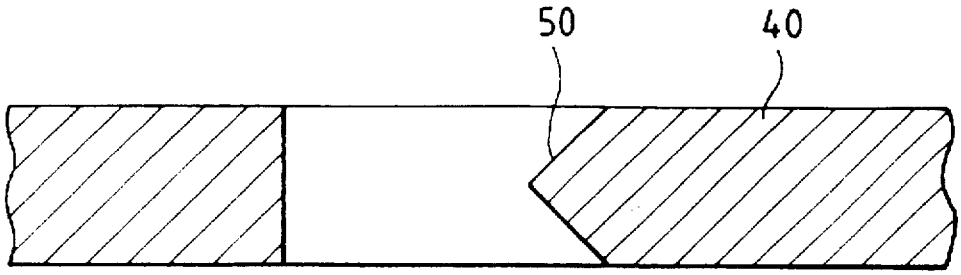
FIGS. 9(*a*) and 9(*b*) are views showing formation of surfaces and overhanging accompanying therewith in an etching process in the case where a synthetic crystal is used as a substrate.
Figure 9B:
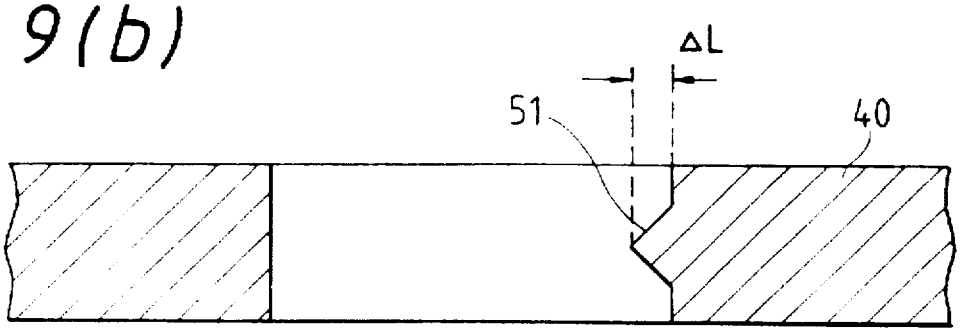

On the other hand, in the case where through-holes are formed by etching of the synthetic crystal substrate 40, overhanging portions 50, 50 as shown in FIG. 9(*a*) are produced from the point of view of the characteristic of the material. By carrying out over-etching in this condition, however, nothing but overhanging portions 51 with a small projecting length ΔL is produced though the area of an opening of the through-hole is increased slightly (FIG. 9(*b*)).

Figure 10:
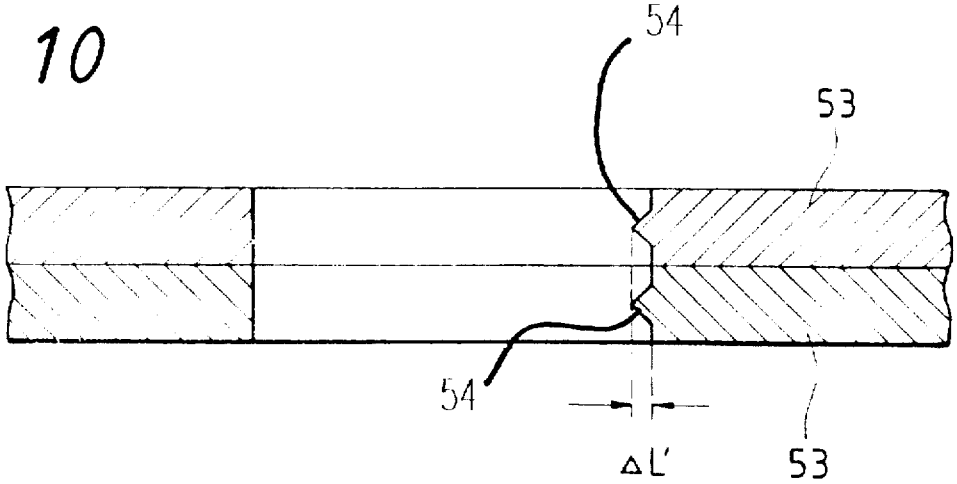
FIG. 10 is a view showing another embodiment of a spacer using a synthetic crystal.

Because over-etching is, however, limited, a through-hole in which overhanging portions 54, 54 having a projecting length ΔL' as small as possible remain can be formed by etching a plurality of thin synthetic crystal substrates 53, 53 in the aforementioned manner, and then laminating the plurality of substrates into a predetermined thickness, as shown in FIG. 10. In the case where one spacer is formed by laminating a plurality of substrates, means of softening the substrates while applying pressure thereto or means of adhering the substrates by a general adhesive agent may be used.

The spacer formed in the aforementioned manner is fixed so as to be inserted between the nozzle plate and the plate member to thereby define a flow passage constituent member. In doing so, respective joint surfaces may be welded under pressure after applying an adhesive agent onto the respective joint surfaces. Because such assembly using an adhesive agent can be performed at ordinary temperatures with respect to the spacer, the nozzle plate and the plate member, there arises an advantage in that not only is the assembly work simple, but also residual heat distortion caused by the difference between the expansion coefficients of the respective members, as experienced in, for example, the case of an alloy joining method, is prevented.

When an adhesive agent is used at the time of joining, there is, however, a problem in that the adhesive agent overflows from the surfaces of adhesion to the through-holes defining the pressure generating chambers and ink supply ports to thereby reduce the volume of each of the through-holes and to thereby change the ink discharge quantity. This occurs even in the case where the quantity of adhesive agent applied is carefully controlled.

Figure 11A:
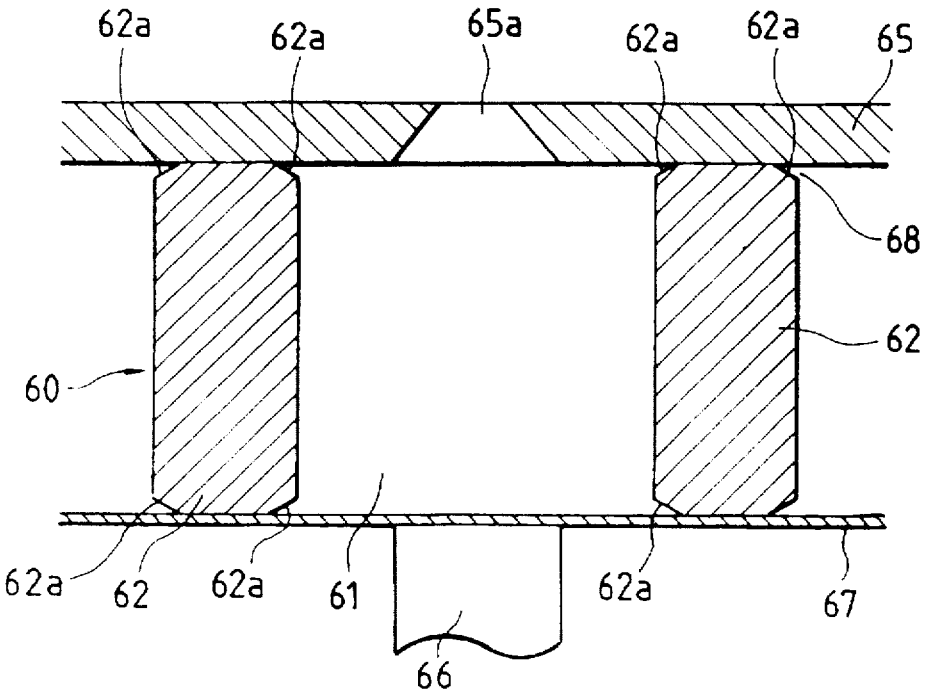
FIGS. 11(*a*) and 11(*b*) are a sectional view showing a further embodiment of a spacer used in an ink-jet type recording head in the present invention and an enlarged view showing surfaces of adhesion.
Figure 11B:
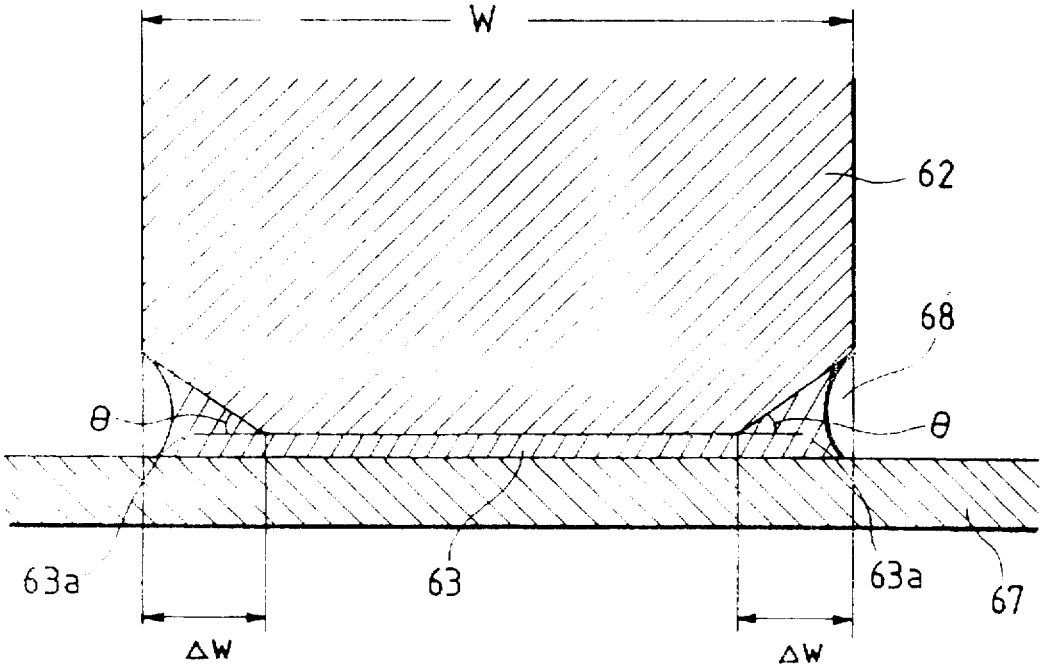

FIGS. 11(*a*)–11(*b*) shows an embodiment of a spacer improved to cope with this problem. In the drawing, reference numeral 60 designates a spacer member constituted by a silicon single crystal substrate or a synthetic crystal. The spacer member is formed so that chambered portions 62*a*, 62*a*, 62*a* . . . having an angle θ with respect to other surfaces of adhesion are provided in edges of partitions 62 partitioning through-holes 61 constituting pressure generating chambers and ink supply ports so as to extend in the direction of length of the partitions 62.

The spacer 60 formed in the aforementioned manner is joined with pressure to the plate member 67 abutting the piezoelectric vibrators 66 and the nozzle plate 65 with the nozzle openings 65*a* after the adhesive agent 63 (FIG. 11(*b*)) is applied onto the surface thereof. Thus, an ink-jet type recording head is assembled.

The adhesive agent 63 overflows from the gap between the spacer 60 and the nozzle plate 65 and the gap between the spacer 60 and the plate member 67 by pressure bonding after application thereof. The overflowing adhesive agent 63*a* enters into sectionally V-shaped spaces 68 formed between the chamfered portions 62*a* and the surface of the plate member 67 or the nozzle plate 65, and spreads along the chamfered portions. Accordingly, the formation of spherical projections in specific points is prevented, as well as the change of compliance of the plate member 67, the increase of fluid resistance of the ink supply ports to a larger value than a set value, and the reduction of the volume of each of the pressure generating chambers below a set value.

Figure 12:
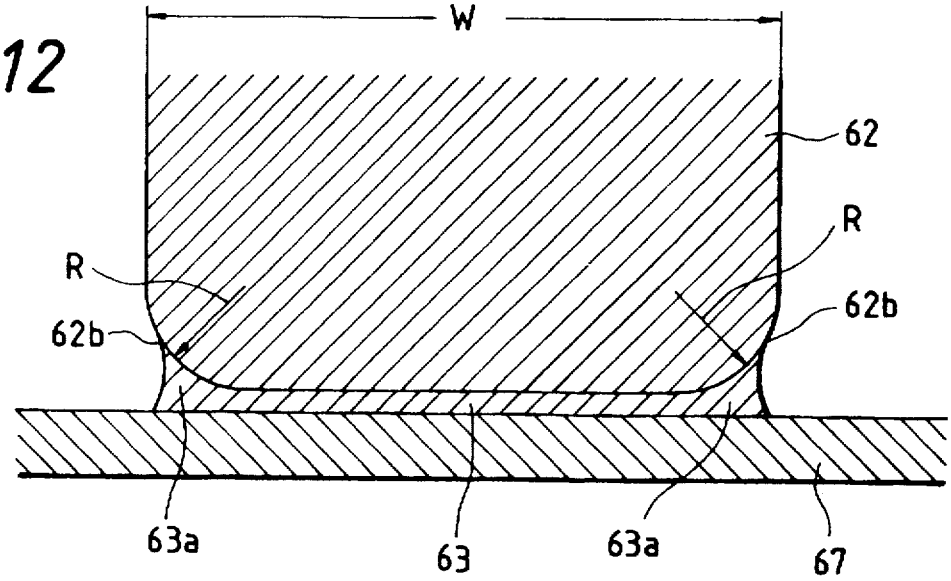
FIG. 12 is an enlarged view showing surfaces of adhesion in a further embodiment of spacer used in an ink-jet type jet recording head in the present invention.

FIG. 12 shows an embodiment in which a spacer is formed by anisotropic etching of a silicon single crystal substrate. In this embodiment, isotropic etching with hydrofluoric acid is applied at the stage in which anisotropic etching is finished. When such isotropic etching is applied, the speed of etching of acute regions such as edge lines formed by the partitions 62 partitioning the through-holes formed by anisotropic etching and the surface becomes larger than the speed of etching of flat portions so that the edge portions are substantially selectively subjected to etching.

In such chamfering using etching, each section is shaped like a circular arc, but sectionally V-shaped concave spaces are formed between the nozzle plate and the plane of the plate member so that the adhesive agent overflowing from the surfaces of adhesion can be absorbed by the spaces.

An adhesive agent having a high viscosity such as an epoxy adhesive agent, etc., is used for joining these members. Because the adhesive agent is applied by a screen printing method, a pad transferring method, a roll coating method, etc., the quantity of the adhesive agent applied can be controlled with a high accuracy. As a result, the function of the chamfered portions 62*a* and 62*b* is not affected as long as spaces capable of absorbing the adhesive agent overflowing from the surfaces of adhesion are available. It has accordingly been confirmed that a volume capable of absorbing the adhesive agent can be secured without reduction of the strength of the wall surfaces as long as the width Δw or radius R of each of the spaces is in a range of from about 1/12 to about 1/6 the thickness 31 (see FIG. 11(*b*)) of each of the partitions 62.

Figure 13:
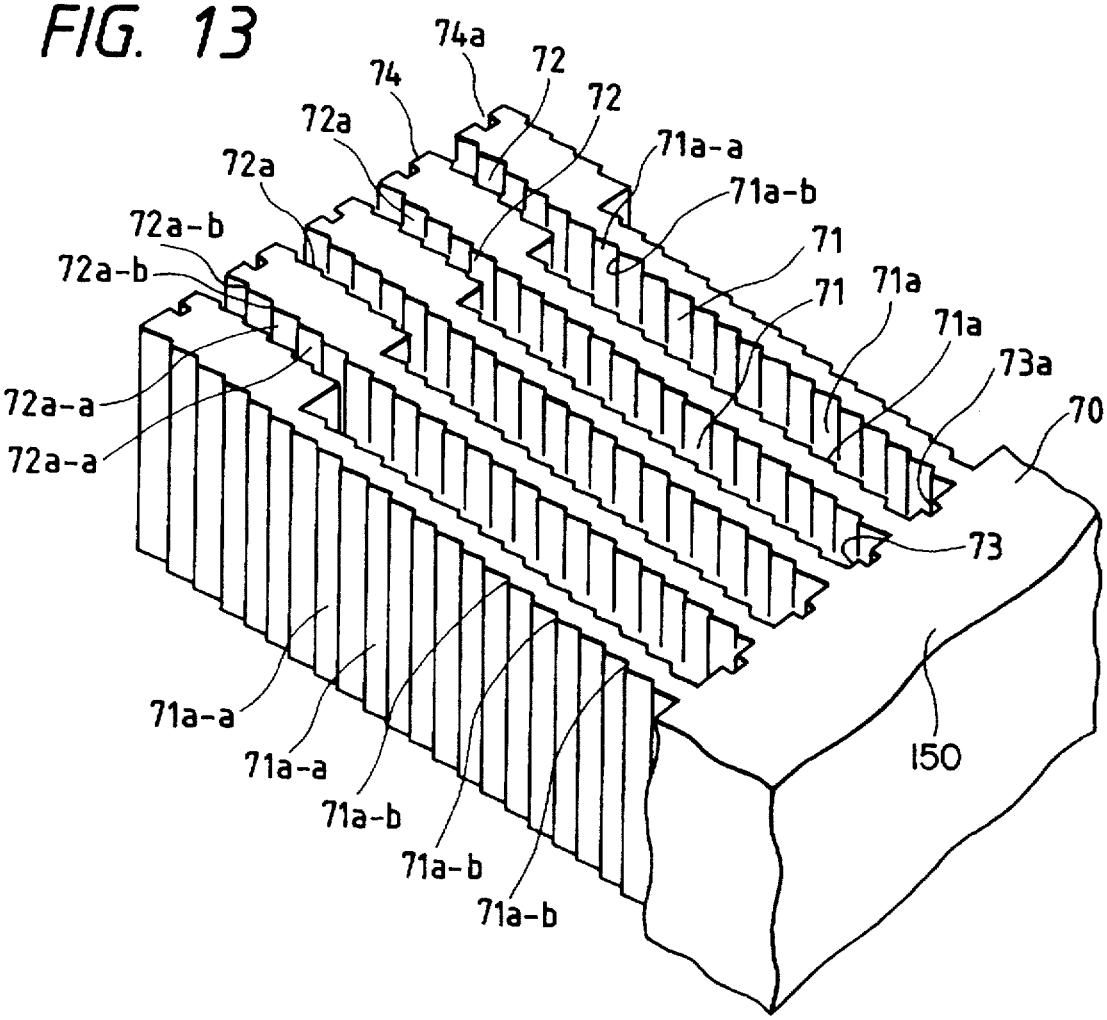
FIG. 13 is an enlarged view showing the vicinity of through-holes constituting pressure generating chambers and ink supply ports in a further embodiment of spacer used in an ink-jet type recording head in the present invention.

FIG. 13 shows another embodiment of an ink-jet type recording head according to the present invention. In the drawing, reference numeral 70 designates a silicon single crystal substrate or a crystal substrate having crystal orientation (110) and having a thickness sufficient to form a spacer. As described above, through-holes 71, 71, 71 . . . to form pressure generating chambers, through-holes 72, 72, 72 . . . to form ink supply ports, and a through-hole to form a reservoir (not shown) are formed by etching.

In this embodiment, wall surfaces 71*a*, 71*a* of the through-holes 71, 71 to form pressure generating chambers and wall surfaces 72*a*, 72*a* of the through-holes 72, 72 to form ink supply ports are arranged sectionally rectangularly so that one surface thereof has a plurality of fine planes 71*a-a*, 71*a-a*, 71*a-a* . . . and 72*a-a*, 72*a-a*, 72*a-a* . . . and predetermined steps 71*a-b*, 71*a-b*, 71*a-b* . . . and 72*a-b*, 72*a-b*, 72*-a-b* . . .

Grooves 73*a* and 74*a* extending in the direction of thickness are formed in surfaces 73, 73, 73 . . ., 74, 74, 74, . . . which do not substantially contribute to forming the aforementioned fine planes.

Figure 14:
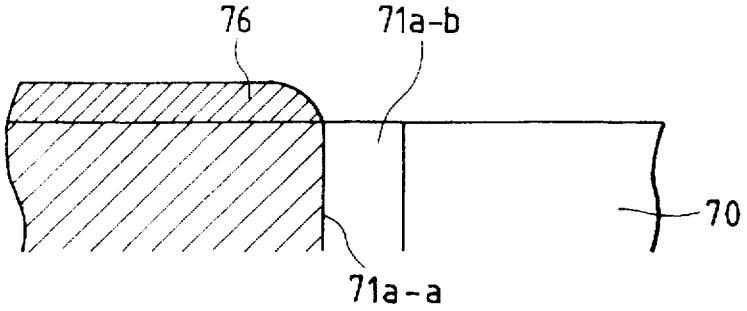
FIGS. 14(*a*) to 14(*d*) are views showing the behavior of an adhesive agent in the case where a nozzle plate and a plate member are joined with the spacer by the adhesive agent.
Figure 14:
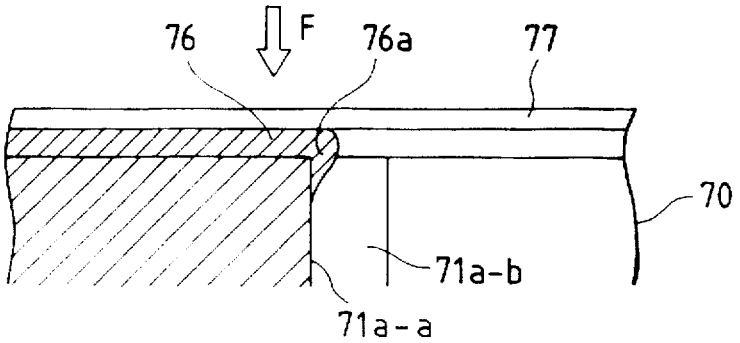
Figure 14:
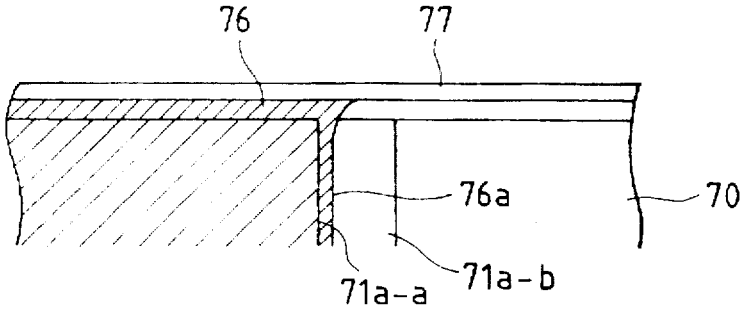
Figure 14:
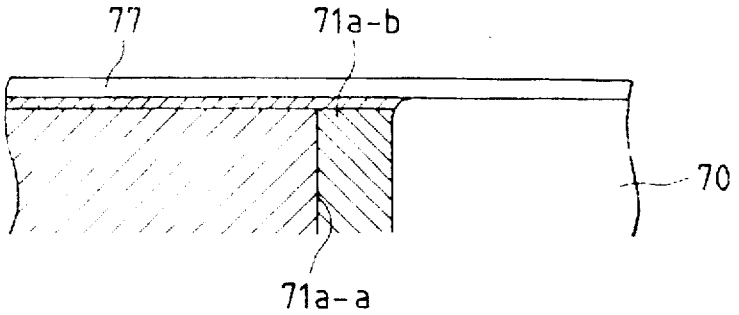

When an adhesive agent 76 such as an epoxy adhesive agent is applied onto surfaces of the thus-formed spacer 70 by a screen printing method, a pad transferring method, a roll coating method or the like to form a predetermined thickness (FIG. 14(*a*)) and then the nozzle plate or plate member 77 is pressed by a predetermined amount of pressure F, the adhesive agent surplus 76*a* overflows to the wall surface side of the spacer 70 (FIG. 14(*b*)).

The adhesive agent spreads along the fine planes 71*a-a* and 72*a-a* due to its surface tension (FIG. 14(*c*)), and then the rectangular spaces constituted by the fine planes 71*a-a* and 72*a-a* and the steps 71*a-b* and 72*a-b* are filled with the adhesive agent (FIG. 14(*d*)). The adhesive agent, overflowing to relatively narrow wall surfaces 73 and 74, is brought into the grooves 73*a* and 74*a* by capillary force so that the adhesive agent cannot overflow to the surface.

Figure 15:
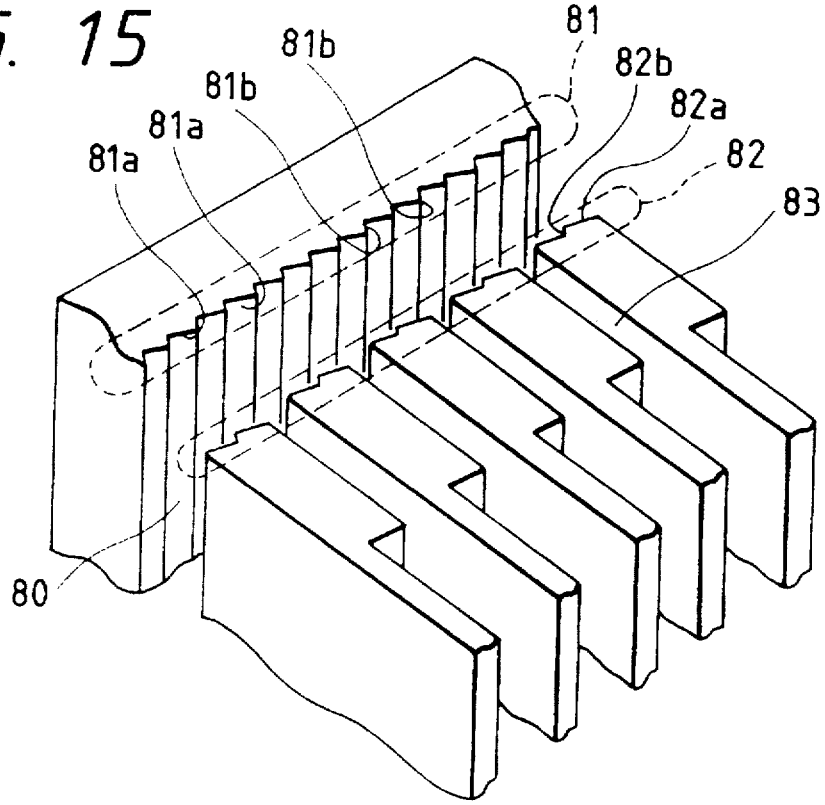
FIG. 15 is a perspective view showing a further embodiment of a spacer used in an ink-jet recording head in the present invention.

Although the aforementioned embodiment relates to the case where fine planes are provided only in wall surfaces to form pressure generating chambers and ink supply ports in which sectional areas must be controlled relatively strictly, it is apparent that the same effect is achieved in the case where a wall surface 81 of a through-hole 80 to form a reservoir and a wall surface 82 for limiting an ink supply port 83 are formed sectionally rectangularly so that the wall surfaces 81 and 82 have fine planes 81*a*, 81*a*, 81*a* . . . and 82*a*, 82*a*, 82*a* . . . and predetermined steps 81*b*, 81*b*, 81*b* . . . and 82*b*, 82*b*, 82*b* . . . shown in FIG. 15, in the same manner as described above. When sectionally rectangular planes are formed with respect to a reservoir, the overflowing of the adhesive agent to the through-holes is prevented so that an ink-jet type recording head higher in quality can be realized.

Figure 16:
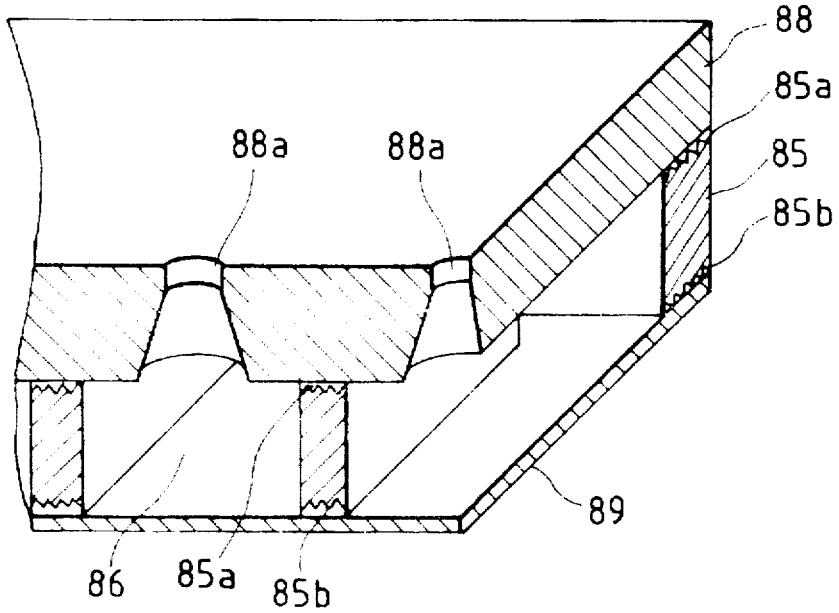
FIG. 16 is a view showing another embodiment of an ink-jet recording head in the present invention.

FIG. 16 shows a further embodiment of an ink-jet type recording head according to the present invention. In the drawing, reference numeral 85 designates a silicon single crystal substrate or a synthetic crystal substrate having a thickness suitable for forming a spacer. Through-holes to form pressure generating chambers 86, ink supply ports and reservoirs are formed by etching. Further, the surfaces of the spacer joined with the nozzle plate 88 having the nozzle openings 88*a* and the plate member 89 by the adhesive agent are roughened by an abrasive material or grinding stone of mean particle size such that concave-convex portions 85*a* and 85*b* with surface roughnesses of the order of microns are formed.

According to this embodiment, the applied adhesive agent flows into the concave-convex portions of the surfaces. When the nozzle plate and the plate member are welded with pressure in this condition, the adhesive agent surplus tending to flow out of the regions of adhesion is kept back by the capillary force of the concave-convex portions of the rough surfaces so that the adhesive agent surplus is prevented from overflowing. As a result, the choking of the nozzle openings and the change of the volume of each of the pressure generating chambers and the ink supply ports is prevented.

Figure 17:
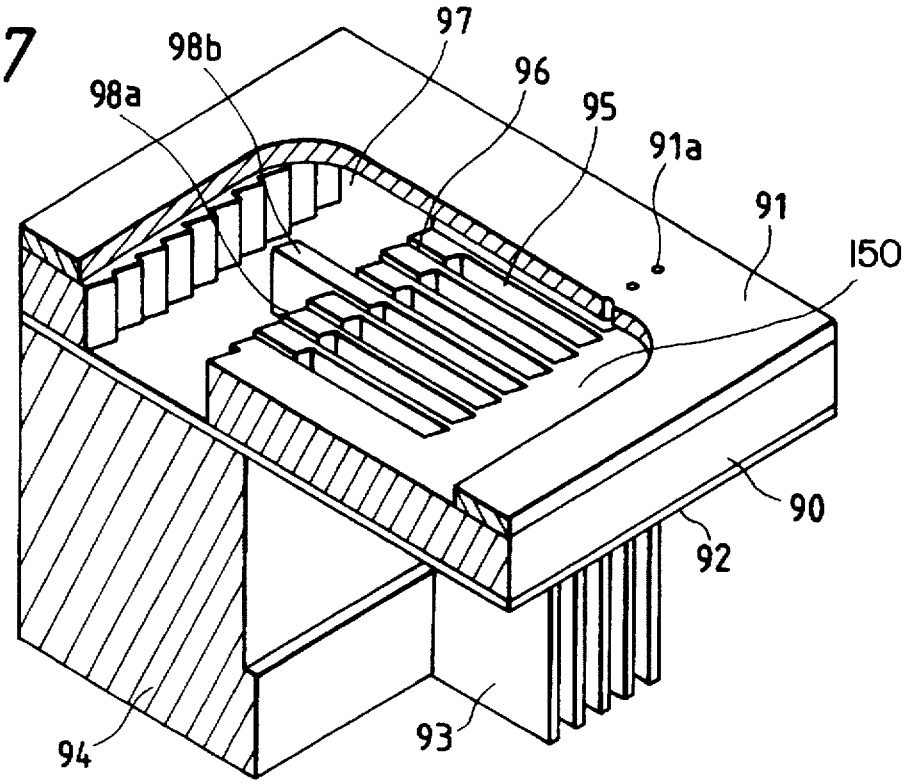
FIG. 17 is a perspective view of a further embodiment of an ink-jet/recording head in the present invention, partly cut away in a nozzle plate.

FIG. 17 shows a further embodiment of the present invention. In the drawing, reference numeral 90 designates a spacer constituted by a silicon single crystal substrate or a synthetic crystal substrate. A nozzle plate 91 having nozzle openings 91*a* and a plate member 92 are fixed to one surface of the spacer, and the other surface of the spacer respectively, by an adhesive agent. The spacer and pressure generating devices such as piezoelectric vibrators 93 in this embodiment are fixed to a pedestal 94 so that a pressure change is induced in the pressure generating chambers by the displacements of the piezoelectric vibrators 93 to thereby discharge ink droplets.

In the spacer 90, through-holes 95 to form pressure generating chambers, through-holes 96 to form ink supply ports and a through-hole 97 to form a reservoir are formed by etching in the aforementioned manner.

Figure 18:
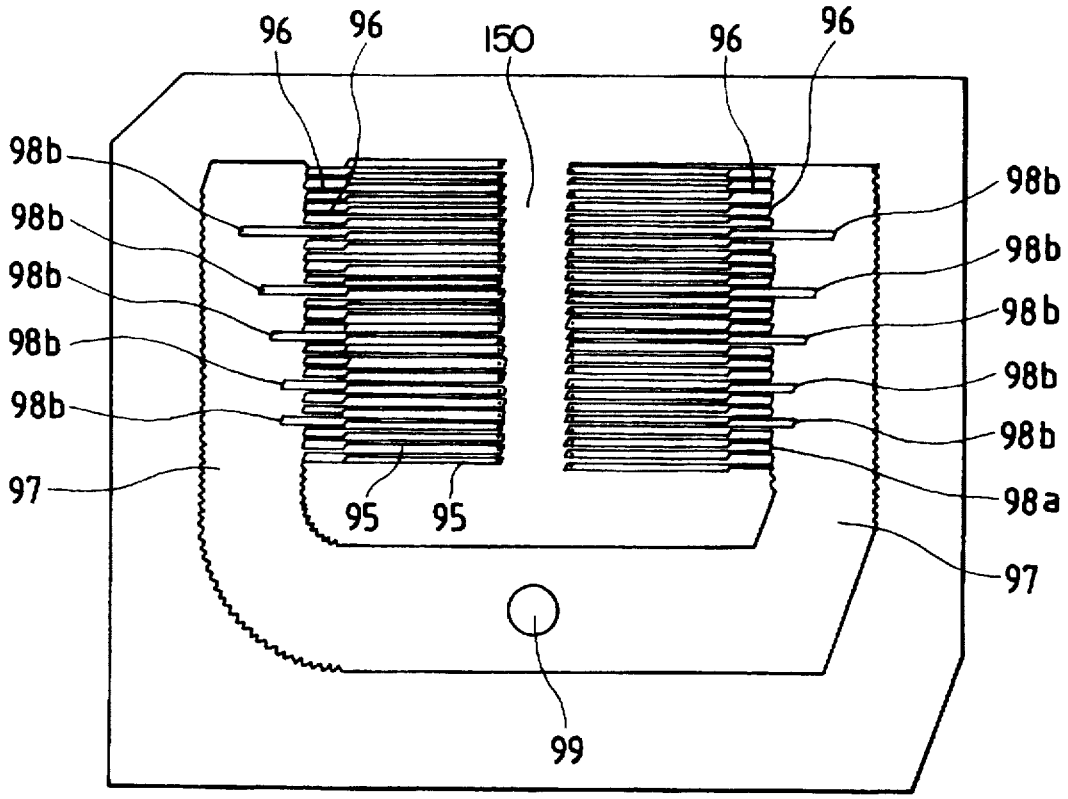
FIG. 18 is a view showing an embodiment of a spacer used in the apparatus.

A plurality of partition portions 98*a*, 98*a*, 98*a* . . . for limiting fluid resistance of the ink supply ports are arranged as shown in FIG. 18. In this embodiment, the partition portions extend toward the through-hole 97 side, that is, toward the reservoir side. The length of the partition portions increase at every fourth ink supply port as the distance between the partition portions and the flow-in port 99 increases.

In this embodiment, the flow of ink from the ink supply port 99 is partly inhibited by the partition portions 98*b*, 98*b* . . . extending toward the reservoir so that the ink flow is converted into an ink flow toward the through-holes 96, 96, 96 . . . to form ink supply ports in the vicinity of the partition portions. On the other hand, a part of the ink flow not inhibited by the partition portions 98*b*, 98*b* . . . enters the deeper side so that the other partition portions 98*b*, 98*b* . . . extending thereto convert the ink flow into an ink flow toward the through-holes 96, 96, 96 . . . to form ink supply ports placed in the vicinity of the partition portions.

As described above, according to the present invention, there is provided an ink-jet type recording head including a nozzle plate provided with nozzle openings for jetting ink droplets; a spacer provided with partitions for partitioning pressure generating chambers, ink supply ports and reservoirs; a plate member fixed to the other surface of the spacer so as to be opposite to the nozzle plate, the spacer, the nozzle plate and the plate member being fixed to each other in a sandwich-like arrangement; and a pressure generating means for applying a change of pressure suitable for forming ink droplets to the pressure generating chambers; characterized in that the spacer is formed by etching a silicon crystalline substrate or a silicon oxide crystalline substrate from its opposite surfaces so that the pressure generating chambers, the ink supply ports and the reservoirs are formed in the form of through-holes communicated with each other; and the spacer is formed in the form of a cantilever so that the partitions for partitioning the pressure generating chambers and the ink supply ports are connected to a body on the nozzle opening side, and the partitions form free ends on the reservoir side. Accordingly, with this arrangement not only can the volume and fluid resistance be controlled with high accuracy because the spaces partitioning the pressure generating chambers, the ink supply ports and the reservoirs can be formed by etching under the same conditions, but the ink can flow without stagnation while the wasteful action of surface tension is eliminated because the wall surfaces partitioning the through-holes are perpendicular to the surface of the substrate.

What is claimed is:

1. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to form said ink droplets;

wherein the improvement comprises:

said spacer is a silicon substrate;

said pressure generating chambers, said ink supply ports, and said reservoirs are through-holes in said spacer and are in communication with each other, said spacer further comprises cantilevered partitions each having a respective fixed end and a respective free end, each of said partitions separating respective adjacent ones of said pressure generating chambers at said respective fixed end, each of said partitions separating respective adjacent ones of said ink supply ports at said respective free end; and said spacer further comprises a body to which said respective fixed end of each of said cantilevered partitions is connected, wherein said cantilevered partitions have chamfered portions with a width of from about 1/12 to about 1/6 of a width of said cantilevered partitions, opposite to said nozzle plate and said plate member, and wherein said spacer is fixed to said nozzle plate and said plate member by an adhesive agent so that spaces defined by said chamfered portions, said nozzle plate and said plate member function as adhesive agent absorbing spaces.

2. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to formn said ink droplets;

wherein the improvement comprises:

said spacer is a silicon substrate;

said pressure generating chambers, said ink supply ports, and said reservoirs are through-holes in said spacer and are in communication with each other, said spacer further comprises cantilevered partitions each having a respective fixed end and a respective free end, each of said partitions separating respective adjacent ones of said pressure generating chambers at said respective fixed end, each of said partitions separating respective adjacent ones of said ink supply ports at said respective free end; and said spacer further comprises a body to which said respective fixed end of each of said cantilevered partitions is connected, wherein:

said spacer is rectangular in section;

each of said cantilevered partitions is constituted by a plurality of planes and predetermined steps; and said spacer is fixed to said nozzle plate and said plate member by an adhesive agent so that said steps function as adhesive agent absorbing spaces.

3. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to form said ink droplets;

wherein the improvement comprises:

said spacer is a silicon substrate;

said pressure generating chambers, said ink supply ports, and said reservoirs are through-holes in said spacer and are in communication with each other, said spacer further comprises cantilevered partitions each having a respective fixed end and a respective free end, each of said partitions separating respective adjacent ones of said pressure generating chambers at said respective fixed end, each of said partitions separating respective adjacent ones of said ink supply ports at said respective free end; and said spacer further comprises a body to which said respective fixed end of each of said cantilevered partitions is connected, wherein said cantilevered partitions include longer ones of said cantilevered partitions that are each longer than each of a remainder of said cantilevered partitions; and said longer ones of said cantilevered partitions are separated from each other by respective ones of said remainder of said cantilevered partitions.

4. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to form said ink droplets;

wherein the improvement comprises:

said spacer is a silicon substrate;

said pressure generating chambers, said ink supply ports and said reservoirs are communicating through-holes of said spacer, wherein said spacer includes cantilevered partitions each disposed between respective adjacent ones of said pressure generating chambers and between adjacent ones of said ink supply ports, said cantilevered partitions each having a respective free end and a respective fixed end that is connected to a body of said spacer, and each having chamfered portions with a width of from about 1/12 to about 1/6 as wide as a respective width of remaining portions of said cantilevered partitions, and wherein said spacer is fixed to at least one of said nozzle plate and said plate member by an adhesive agent so that spaces defined by said chamfered portions, and by said at least one of said nozzle plate and said plate member, function as adhesive agent absorbing spaces.

5. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to form said ink droplets;

wherein the improvement comprises:

said spacer is a silicon substrate;

said pressure generating chambers, said ink supply ports and said reservoirs are communicating through-holes of said spacer;

said spacer is rectangular in section and includes cantilevered partitions disposed between adjacent ones of said pressure producing chambers and said ink supply ports, each of said cantilevered partitions being constituted by a plurality of planes and predetermined steps, said cantilevered partitions each having a respective fixed end and a respective free end, said respective fixed end of each of said cantilevered partitions being connected to a body of said spacer; and said spacer is fixed to said nozzle plate and said plate member by an adhesive agent so that said steps function as adhesive agent absorbing spaces.

6. An ink-jet recording head, comprising:

a nozzle plate provided with nozzle openings for jetting ink droplets;

a spacer provided with pressure generating chambers, ink supply ports, and reservoirs;

said nozzle plate being fixed to one surface of said spacer, a plate member fixed to another surface of said spacer so as to be opposite to said nozzle plate, said spacer and said plate member being sandwiched and fixed to each other, said nozzle openings each communicating with a respective one of said pressure generating chambers; and pressure generating means for applying a change of pressure to said pressure generating chambers to form said ink droplets;

wherein the improvement comprises:

said spacer is a silicon substrate;

said pressure generating chambers, said ink supply ports and said reservoirs are through-holes of said spacer and are in communication with each other, said spacer further comprises cantilevered partitions each separating respective adjacent ones of said pressure generating chambers and separating respective adjacent ones of said ink supply ports, said cantilevered partitions each having a respective fixed end and a respective free end, said respective fixed end being connected to a body of said spacer; and said cantilevered partitions include longer ones of said cantilevered partitions and remaining ones of said cantilevered partitions, each of said longer ones of said cantilevered partitions being separated from each other by a plurality of said remaining ones of said cantilevered partitions.

* * * * *